US006490821B1

(12) United States Patent
Lacek

(10) Patent No.: US 6,490,821 B1
(45) Date of Patent: Dec. 10, 2002

(54) PRINTABLE TAG WITH INTEGRAL FASTENER

(75) Inventor: Kevin C. Lacek, River Falls, WI (US)

(73) Assignee: Lowry Computer Products, Inc., Brighton, MI (US)

( * ) Notice: Subject to any disclaimer, the term of this patent is extended or adjusted under 35 U.S.C. 154(b) by 0 days.

(21) Appl. No.: 09/624,427

(22) Filed: Jul. 24, 2000

(51) Int. Cl.[7] ..... G09F 3/14
(52) U.S. Cl. ..... 40/673; 24/16 PB
(58) Field of Search ..... 40/673, 665, 668, 40/630; 24/16 PB, 17 AP, 30.5 P, 30.5 R; 283/80, 79, 74; D20/22, 27

(56) References Cited

U.S. PATENT DOCUMENTS

| | | | |
|---|---|---|---|
| 261,164 | A | 7/1882 | Lynk |
| 281,733 | A | 7/1883 | Sears |
| 324,388 | A | 8/1885 | Joslin |
| 627,920 | A | 6/1899 | Gould |
| 876,294 | A | 1/1908 | Brown et al. |
| 1,309,904 | A | 7/1919 | Mills et al. |
| 1,324,568 | A | 12/1919 | Shelton |
| 1,506,956 | A | 9/1924 | Thompson |
| 2,183,799 | A | 12/1939 | Wenk, Jr. |
| 2,768,458 | A | 10/1956 | Anania |
| 3,550,295 | A | 12/1970 | Anania |
| 3,837,101 | A | 9/1974 | Young |
| 4,142,310 | A | 3/1979 | Groselak |
| 4,630,384 | A | 12/1986 | Breen |
| 4,726,131 | A | 2/1988 | Cass |
| 4,914,843 | A | 4/1990 | Dewoskin |
| D317,181 | S | 5/1991 | Nozawa |
| 5,104,148 | A | 4/1992 | Neal |
| 5,141,254 | A | 8/1992 | Ring |
| 5,151,403 | A | 9/1992 | Suzuki et al. |
| 5,271,642 | A | 12/1993 | Jahier et al. |
| 5,381,617 | A | 1/1995 | Schwartztol et al. |
| 5,538,289 | A | 7/1996 | Cassis, III |
| 5,673,943 | A | 10/1997 | Campbell |
| 5,782,496 | A | 7/1998 | Casper et al. |

FOREIGN PATENT DOCUMENTS

| | | | | |
|---|---|---|---|---|
| FR | 1435102 | * | 3/1966 | ..... 24/16 PB |

* cited by examiner

*Primary Examiner*—Cassandra H. Davis
(74) *Attorney, Agent, or Firm*—Harness, Dickey & Pierce, P.L.C.

(57) ABSTRACT

The printable substrate of biaxially multi-layered laminate material is perforated to define a flap overlying a window having a frame. The window is sized to allow the tag body to be passed through it and thereby secure the tag to an article. The tag substrate may be provided as a continuous web that has been perforated to define multiple tags, suitable for printing and dispensing by automated mechanism.

16 Claims, 4 Drawing Sheets

PRINTABLE TAG WITH INTEGRAL FASTENER

BACKGROUND AND SUMMARY OF THE INVENTION

The present invention relates generally to tags and labels. More particularly, the invention relates to a printable tag with integral fastener suitable for being printed and dispensed by mechanical means. The integral fastener allows the tag to be quickly attached to goods, shipping containers or dunnage, without the need to install a separate string or wire fastener.

Shipping tags and labels are used throughout industry for inventory control, shipping origin and destination addressing, component identification, just-in-time manufacturing, specimen labeling, and the like. Traditionally, most industries have used a simple paper tag with separate wire or string fastener, designed to be written on by hand and then attached to the article. Although this paper tag can be printed on and dispensed mechanically, the wire or string fastener must be installed separately so as not to jam the feeding and printing apparatus.

With the prevalence of many inventory management systems, process flow control systems and shipping systems now operating under computer control, there is considerable interest in a printable tag that works in this automated environment. Desirably, the tag should be printed and dispensed as part of the automated manufacturing, shipping and/or storage process, with the tag being ready for immediate application to the article. In this way, accurate correlation between the tag and the article is ensured and the manufacturing, shipping and/or storage process proceeds efficiently.

To meet the needs of today's automated environments, the invention provides a printable tag with integral fastener that requires no separate string or wire fastener. The tag employs a printable substrate that is provided with a first slit which defines a flap overlying a window with a frame. A second slit, extending from one edge of the substrate, defines a first locking tab. A third slit, extending from another edge of the substrate, defines a second locking tab. The window is sized to allow the tag body to be passed through it.

In use, the tag is applied by wrapping or looping the tag body around the article to be tagged, and inserting the second end of the tag body into the window and pulling the tag tight.

The presently preferred tag is a biaxially multi-layered laminate of polyethylene with a matte top coating to support printing by suitable thermal printer or laser printer.

For a more complete understanding of the invention, its objects and advantages, refer to the following specification and to the accompanying drawings.

DESCRIPTION OF THE PREFERRED EMBODIMENTS

Figure 1:
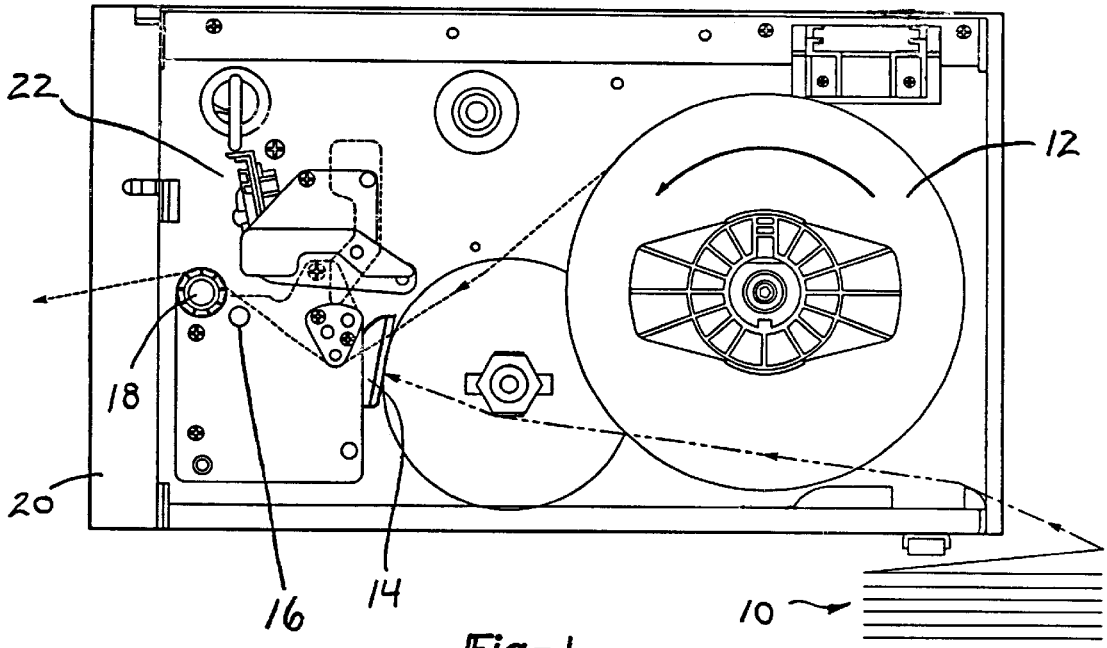
FIG. 1 is a cross-sectional view of an exemplary printing and labeling apparatus useful in understanding how the printable tag of the invention may be deployed.

The printable tag of the invention may be deployed manually or by mechanized printing and dispensing apparatus. Such apparatus is illustrated in FIG. 1, in which the printable tag of the invention is illustrated in fanfold form at 10 and in roll form at 12. In both forms the tag stock comprises a perforated web of tags arranged end-to-end.

Whether provided in fanfold form or roll form, the tag media is fed through the printing and dispensing mechanism as illustrated by the broken lines in FIG. 1. Specifically, the tag media is passed through media guide 14, past the media edge sensor 16, around the capstan 18 and out through the front of the dispensing mechanism 20. The dispensing mechanism can be provided with a print mechanism or print head 22 that applies printed information, such as alphanumeric text or barcode information to the printable surface of the tag substrate.

Figure 2:
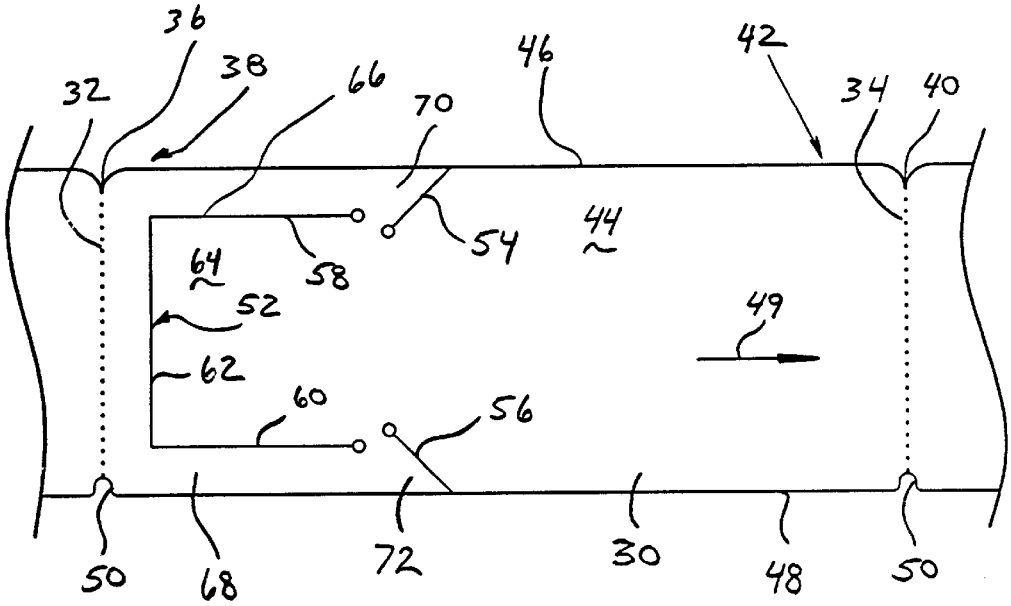
FIG. 2 is a plan view of the printable tag according to the presently preferred embodiment thereof.

Referring to FIG. 2, the printable tag comprises a diecut printable substrate 30 that defines an elongated web of material from which a plurality of tags are constructed. The presently preferred substrate is a biaxially multi-layered laminate of polyethylene. Suitable material can be obtained from Van Leer Flexible Packaging, Houston, Tex. The material is sold under the trade name Valeron. The multi-layered laminate is desired because it is virtually tear proof. The individual laminate layers are arranged so that the grain of one layer is orthogonal to the grain of the next layer. The presently preferred embodiment employs at least one matte finish top coating, to allow the tag to be printed on by thermal printing or laser printing means.

The substrate is perforated, as at 32 and 34, generally perpendicular to the longitudinal dimension of the substrate. Perforations 32 and 34 thus define a left side edge 36 at a first end 38 and a right side edge 40 at a second end 42 of a single tag body 44. An upper longitudinal edge 46 and a lower longitudinal edge 48 are defined by the dimensions of the tag stock roll or fanfold. The preferred direction of web travel has been indicated in FIG. 2 by arrow 49.

Along lower longitudinal edge 48 of the tag are formed a series of media sensor notches 50. Preferably, these notches coincide with perforations 32 and 34 and are used by the media edge sensor 16 (FIG. 1) to notify the printing and dispensing mechanism where one tag ends and the next tag begins.

The substrate 30 is provided with a first generally "C" shaped slit or perforation 52, a second downwardly extending slit or perforation 54 and a third upwardly extending slit or perforation 56. First slit 52 includes a first portion 58 longitudinally extending generally adjacent to upper longitudinal edge 46. First slit 52 also includes a second portion 60 longitudinally extending generally adjacent to lower longitudinal edge 48. A third portion 62 extends transversely across substrate 30 interconnecting first portion 58 and second portion 60. Accordingly, "C" shaped slit 52 defines a flap 64 overlying a window 66 having a frame 68.

Second slit 54 extends downwardly at an angle from upper longitudinal edge 46 toward window 66 to define a first locking tab 70. Preferably, second slit 54 extends inwardly beyond first portion 58 to assure a clearance between frame 68 and first locking tab 70. Similarly, third slit 56 extends upwardly from lower longitudinal edge 48 toward window 66 to define a second locking tab 72. Flap 64 may be displaced to open window 66 to allow second end 42 of tag body 44 to be passed through window 66 during installation.

Operation

Figure 3:
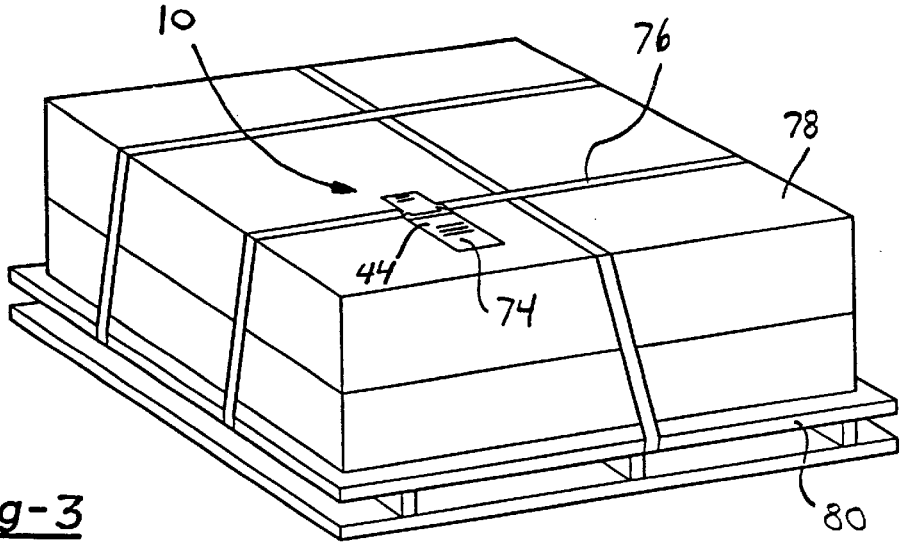
FIG. 3 is a perspective view of an exemplary container having the preferred tag embodiment coupled thereto.
Figure 4:
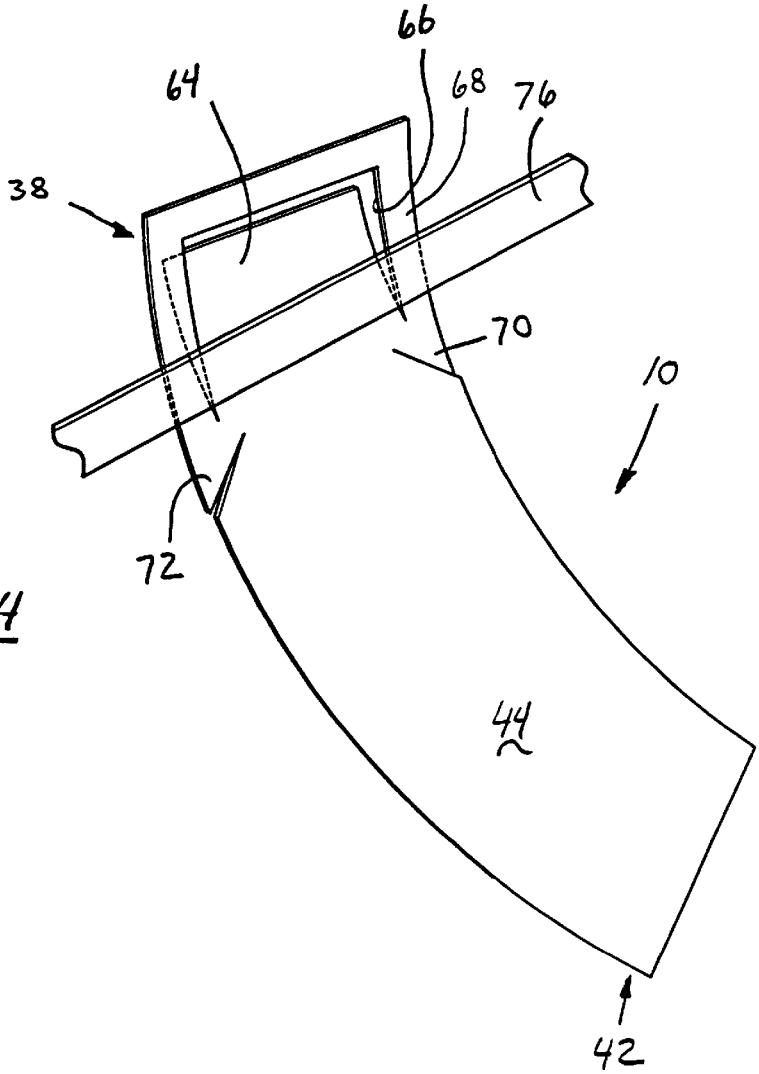
FIGS. 4–7 illustrate the use of the tag.

Referring to FIGS. 3 and 4, printing 74 is supplied to tag 10 using a suitable print engine such as the one illustrated in FIG. 1. Thereafter, perforations 32 and 34 are separated to free tag 10 from the remaining tag stock. Subsequently, tag body 44 is wrapped around the article to be tagged. In this case, a tag body 44 is coupled to a band 76 used to secure a container 78 to a pallet 80.

Figure 5:
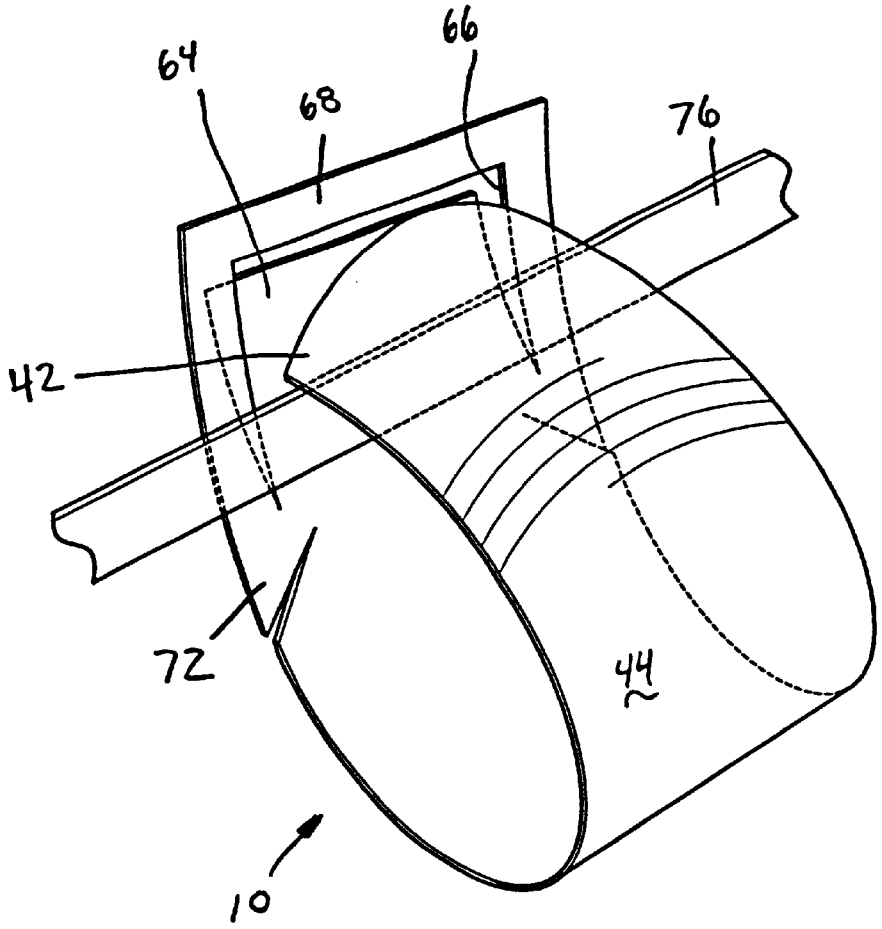
Figure 6:
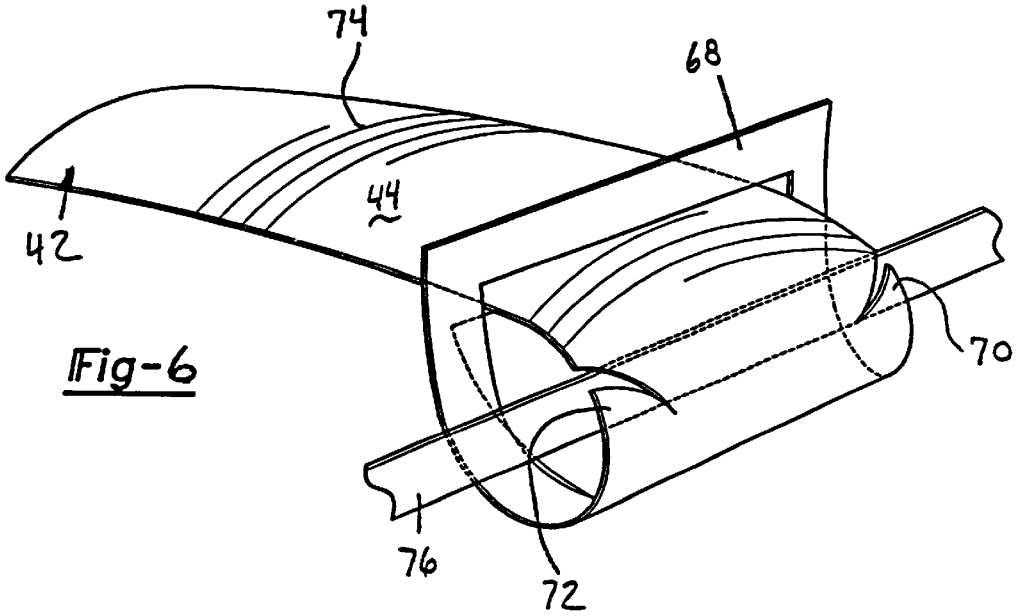
Figure 7:
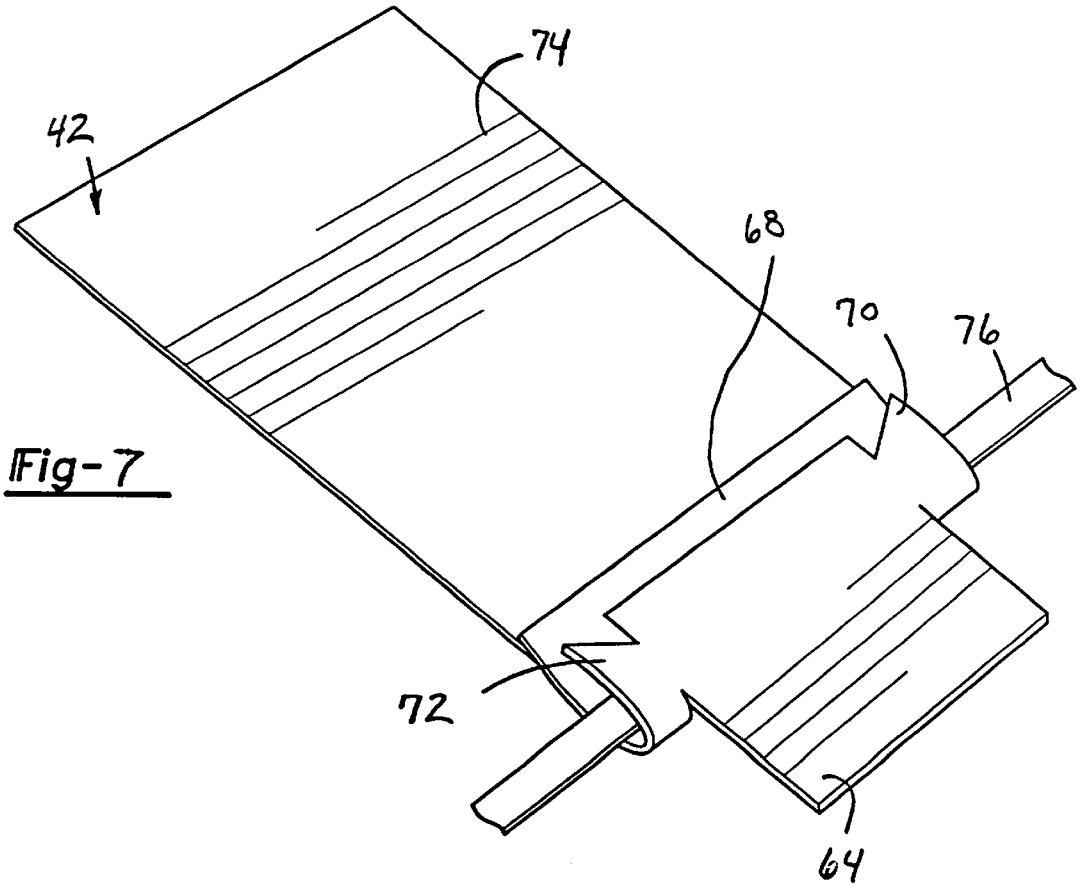

As shown in FIGS. 5 and 6, second end 42 is passed through window 66. The tag is then pulled tight, causing first locking tab 70 and second locking tab 72 to engage window frame 68 thereby forming a knot around band 76 to which the tag is attached as shown in FIG. 7.

The foregoing discussion discloses and describes merely exemplary embodiments of the present invention. While the invention has been described in its presently preferred form, it will be understood that certain modifications can be made to the printable tag without departing from the spirit of the invention as set forth in the appended claims.

What is claimed is:

1. A printable tag with integral fastener comprising:

a printable substrate defining a tag body having a first end, a second end, and first edge, and a second edge;

a first slit formed in said substrate at said first end defining a flap overlying a window with a frame, said window being sized to allow said tag body to be passed through it, wherein said first slit includes a first portion extending laterally adjacent said first edge, a second portion extending laterally adjacent said second edge and a third portion interconnecting said first and second portion; and a second slit extending from said first edge toward said window to define a first locking tab adapted to interlock with said frame.

2. The tag of claim 1 wherein said printable substrate carries printed information.

3. The tag of claim 1 wherein said printable substrate is a polyethylene material.

4. The tag of claim 1 wherein said printable substrate comprises a machine feedable perforated web.

5. The tag of claim 1 wherein said printable substrate is a biaxially multi-layered laminate.

6. The tag of claim 1 further including a third slit extending from said second edge toward said window to define a second locking tab adapted to interlock with said frame.

7. A printable tag with integral fastener comprising:

a substrate having a printable surface, said substrate defining a tag body having a first end, a second end, a first edge and a second edge;

a first slit formed in said substrate at said first end defining a flap overlying a window with a frame, said window being sized to allow said second end to be passed through it; and a second slit extending from said first edge toward said window to define a first locking tab adapted to interlock with said frame, Whereby after said first locking tab is interlocked with said frame, said printable surfaces of said flap and said second end are substantially co-planar.

8. The tag of claim 7 further including a third slit extending from said second edge toward said window to define a second locking tab adapted to interlock with said frame.

9. The tag of claim 8 wherein said second slit and said third slit terminate at points spaced apart a first distance, said window having a minimum width greater than said first distance.

10. The tag of claim 7 wherein said printable substrate carries printed information.

11. A printable tag with integral fastener comprising:

a printable substrate defining a tag body having a first end, a second end, a first edge and a second edge;

a first slit formed in said substrate at said first end defining a flap overlying a window with a frame;

a second slit formed in said substrate and extending inwardly from said first edge and away from said second end to define a first locking tab; and a third slit formed in said substrate extending inwardly from said second edge and away from said second end to define a second locking tab, said window being sized to allow said second end to be passed through it, said first and second locking tabs adapted to interlock with said frame.

12. The tag of claim 11 wherein said first locking tab and said second locking tab are configured to limit insertion of said second end through said window.

13. The tag of claim 11 wherein said first slit terminates at a first location and a second location, wherein said second slit extends inwardly beyond said first location and said third slit extends inwardly beyond said second location.

14. A method for attaching a printable tag to an object comprising:

printing information on one side of a substrate having a first end and a second end wherein said first end includes a first slit defining a flap positioned within a window having a frame;

inserting said second end through said first slit thereby trapping the object to be tagged within a loop defined by said substrate;

translating said second end through said window until said frame engages a second slit wherein said second slit defines a first tab that restricts further movement of said second end through said window.

15. The method of claim 14 further including the step of aligning said flap and said second end such that the printed surfaces are substantially co-planar.

16. The method of claim 14 further including the step of translating said second end through said window until said frame engages a third slit wherein said third slit defines a second tab that restricts further movement of said second end through said window.

* * * * *